United States Patent [19]

O'Toole et al.

[11] 4,066,168

[45] Jan. 3, 1978

[54] REFERENCE MANUAL STAND

[75] Inventors: Jerome O'Toole; David M. Wright, both of Shrewsbury; Norman A. Hedstrom, Worcester, all of Mass.

[73] Assignee: Wright Line Inc., Worcester, Mass.

[21] Appl. No.: 671,390

[22] Filed: Mar. 29, 1976

[51] Int. Cl.[2] ..... A47B 19/00

[52] U.S. Cl. ..... 211/4; 211/42; 248/451

[58] Field of Search ..... 211/4, 8, 42, 43; 248/451, 452, 441 R, 453, 456; 281/15 A, 16

[56] References Cited

U.S. PATENT DOCUMENTS

| | | | |
|---|---|---|---|
| 660,264 | 10/1900 | Storm | 211/42 X |
| 1,772,438 | 8/1930 | Cubberley | 211/43 X |
| 2,095,053 | 10/1937 | Buchan | 211/43 X |
| 2,232,635 | 2/1941 | Rogers | 211/43 |
| 2,271,734 | 2/1942 | Donham | 211/42 X |
| 2,546,419 | 3/1951 | Ashley | 211/42 |
| 2,627,272 | 2/1953 | Segal | 211/42 |
| 3,200,958 | 8/1965 | Hudgeons et al. | 211/4 |
| 3,233,611 | 2/1966 | Stewart et al. | 211/42 X |
| 3,294,245 | 12/1966 | Parle | 211/42 |
| 3,980,360 | 9/1976 | Wright et al. | 312/184 |

FOREIGN PATENT DOCUMENTS

| | | | |
|---|---|---|---|
| 1,207,338 | 12/1965 | Germany | 312/184 |
| 46,907 | 6/1888 | Germany | 248/452 |
| 134,587 | 2/1952 | Sweden | 211/8 |
| 12,656 of | 1915 | United Kingdom | 248/456 |

*Primary Examiner*—Roy D. Frazier
*Assistant Examiner*—Thomas J. Holko
*Attorney, Agent, or Firm*—Milton E. Gilbert

[57] ABSTRACT

A novel stand is provided for supporting reference manuals of the type comprising a loose leaf holder with a hook located intermediate its end. The stand features means for preventing the holders from moving side-to-side and means adapted to interlock with the hooks of the holders to secure the latter in place. As added features, a key-operated locking device may be provided to prevent removal of the holders from the stand and two wire "flyleafs" may be attached to the stand to support the pages of the attached manuals when they are opened.

13 Claims, 8 Drawing Figures

REFERENCE MANUAL STAND

This invention relates to the art of holding documents for reference use and more particularly to stands for supporting reference manuals and the like so that they can be opened and read in place.

It is common practice to form loose-leaf manuals or books by placing documents such as catalog pages, computer printouts, specification sheets, reports, drawings and the like in loose-leaf binders or holders. This practice helps protect the documents and also makes them easier to handle, locate and use. Substantial efforts also have been made with respect to mounting reference manuals so that they can be readily referred to for use. Thus, telephone directories, parts catalogs and the like are commonly attached to counter tops or stands so that they can be opened in place but they cannot be dislodged accidentally or removed to another area. Another approach has been to provide loose-leaf binders or document holders which are provided with one or more hooks so that they can be stored in a suspension type filing system. Such binders may have two hooks, one at each end, to enable them to be slidably hung on a pair of side rails. Additionally or alternatively, the holder may have a hook located between its ends so that it may be suspended from a single rail. Both modes of suspension filing systems are referred to in U.S. Pat. No. 3,865,445 issued Feb. 11, 1975 to Carl J. Dean et al. for HANGING BINDER. However, it also is desirable to be able to take loose-leaf holders which are designed for suspension filing systems and mount them to a lectern-type stand so that they may be opened and read in place conveniently and without risk of falling off.

Accordingly, the primary object of this invention is to provide a system whereby documents may be assembled in the form of books and attached to a support stand so that they can be opened and read in place, and a further object is to provide a support stand for use in such systems.

Another object is to provide a novel support stand for securing books of the type that are adapted to be stored in a suspension filing system, the support stand having means for attaching the books thereto so that they can be opened and read in place.

Additional objects are to provide (1) support stands of the character described having means for locking books thereto to prevent unauthorized removal and/or (2) flyleaf means for supporting the opened pages of a book.

The foregoing objects, as well as other objects will be obvious to a person skilled in the art from the description which follows, are achieved by providing a support which comprises a plate with means for engaging a hook on the spine of a document holder so as to attach the holder to the plate, and means for restraining the holder against lateral movement. The support also may include a key-operated locking means that interlock with and secure the holders to the plate. Other features and many of the attendant advantages are set forth in the following specification and the accompanying drawings which disclose a preferred embodiment of the invention.

Figure 1:
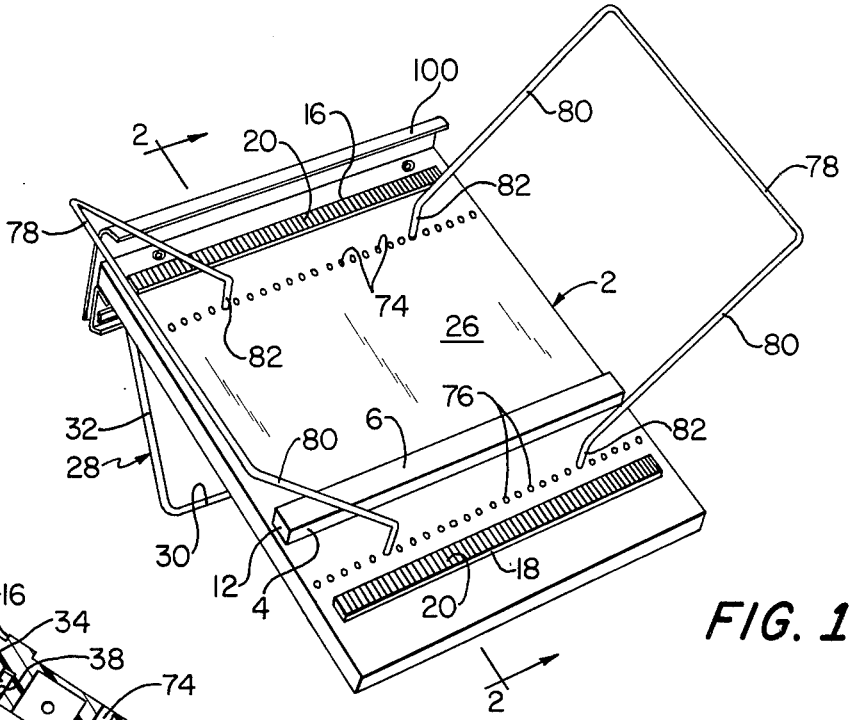
FIG. 1 is a perspective view of a book stand constructed in accordance with the present invention.
Figure 2:
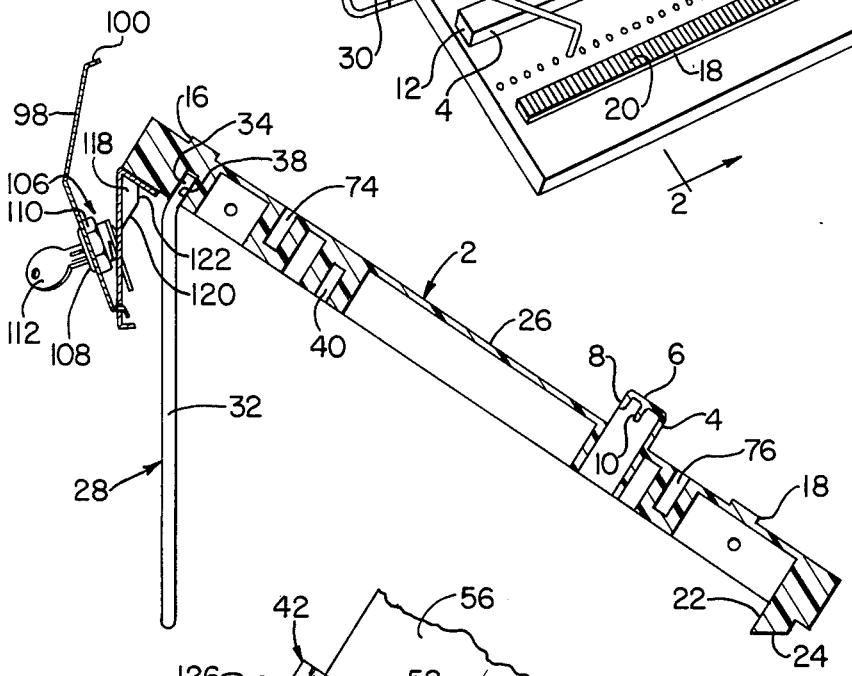
FIG. 2 is a sectional view taken substantially along line 2—2 of FIG. 1.
Figure 3:
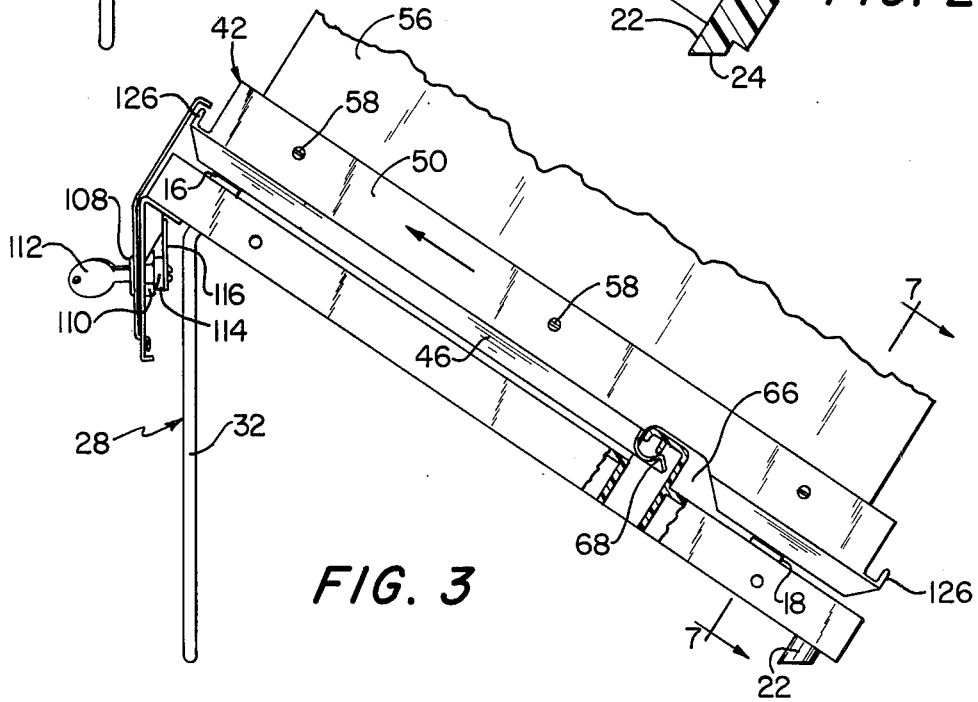
FIG. 3 is a view like FIG. 2 but with the locking plate in closed position.

Referring now to FIGS. 1–3, there is shown a book support assembly or stand which comprises a plate or board 2 which may be made of metal but preferably is made of a suitable thermoplastic or thermosetting plastic such as polypropylene, reinforced nylon, a polyester, ABS or an epoxy resin. As formed the plate is characterized by an elongate rib 4 which is located intermediate its upper and lower ends. Rib 4 is provided with a flange 6 which extends substantially parallel to the plane of plate 2. A lip 8 is formed at the free end of flange 6 so that the flange and lip cooperate with rib 4 to provide a hook shaped cross-section (see FIGS. 2 and 3). A fin 10 also is formed, integral with the under side of flange 6 intermediate the rib 4 and the lip 8. Additionally, end walls 12 are formed integral with and close off the space formed by rib 4, flange 6, lip 8 and plate 2. As a consequence an elongate rectangular opening is formed by the lower edge of lip 8, the upper surface 26 of plate 2, and the inner surfaces of end wall 12.

Figure 7:
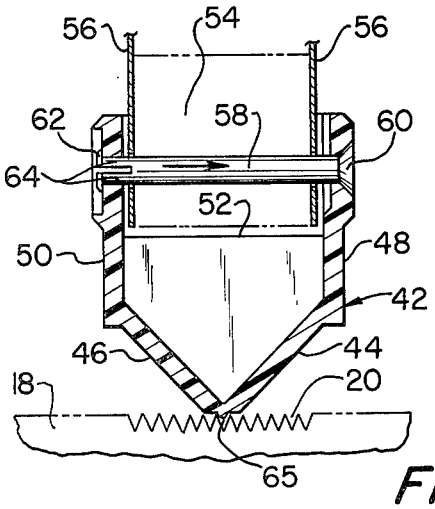
FIG. 7 is a cross-sectional view taken substantially along line 7—7 of FIG. 3.
Figure 6:
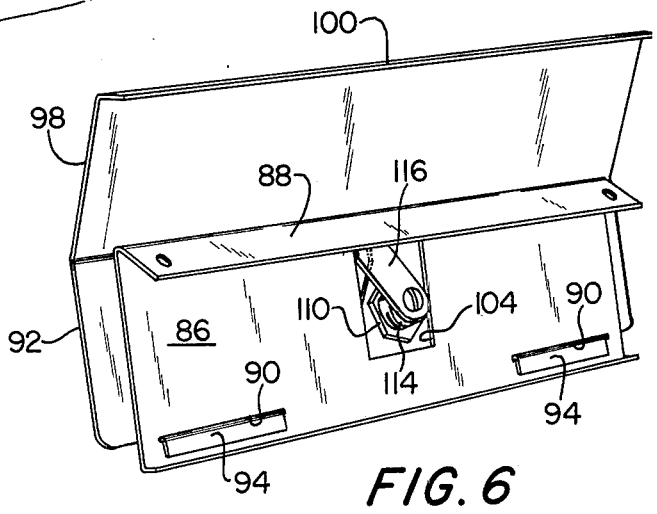
FIG. 6 is a view like FIG. 5 but with the locking plate in closed position.

The support plate 2 also is provided with two additional ribs 16 and 18 which are located adjacent to its upper and lower edges and are serrated due to provision of grooves 20 which preferably are V-shaped in cross-section as shown in FIG. 7. The grooves 20 in rib 16 are aligned with corresponding grooves 20 in rib 18 and cooperate with the lip 8 and fin 10 on rib 4 to secure reference manuals, catalogs, and other books comprising suitable loose-leaf holders as hereinafter described.

Still referring to FIGS. 1–3, the plate 2 is formed on its underside with two projections 22, each located adjacent a lower corner of the plate, which functions as legs. The projections 22 have bottom surfaces 24 which are in a plane which extends at an acute angle to the upper surface 26 of plate 2. Cooperating with legs 22 is a removable wire leg unit 28 which consists of a bottom connecting section 30 and two upstanding leg sections 32. The upper ends of leg sections 32 are bent so as to form angular extensions 34 which are received within suitable openings formed in the underside of plate 2. Preferably, plate 2 is formed with two sets of leg receiving openings on its underside as shown at 38 and 40, so that by shifting leg unit 28 from holes 38 to holes 40 it is possible to shift the angle at which the plate 2 is supported. This is advantageous in that it allows the angle of the plate 2 to be changed according to whether the user is sitting down or is standing up.

Figure 4:
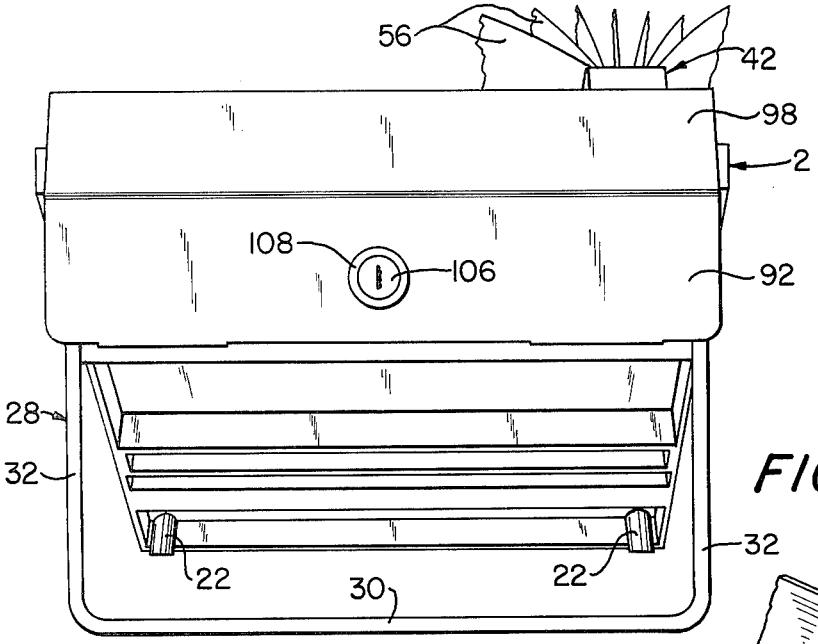
FIG. 4 is a rear view in elevation of the same book stand.
Figure 8:
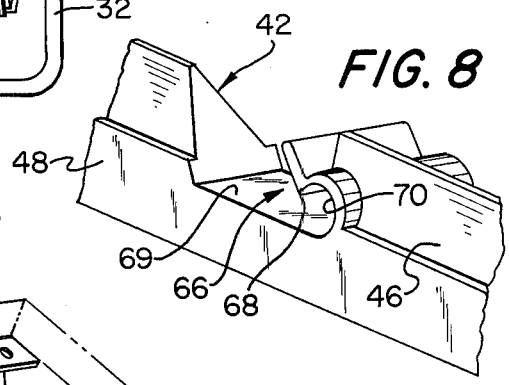
FIG. 8 is a fragmentary perspective view of the holder of FIGS. 3 and 7 in upright position.
Figure 5:
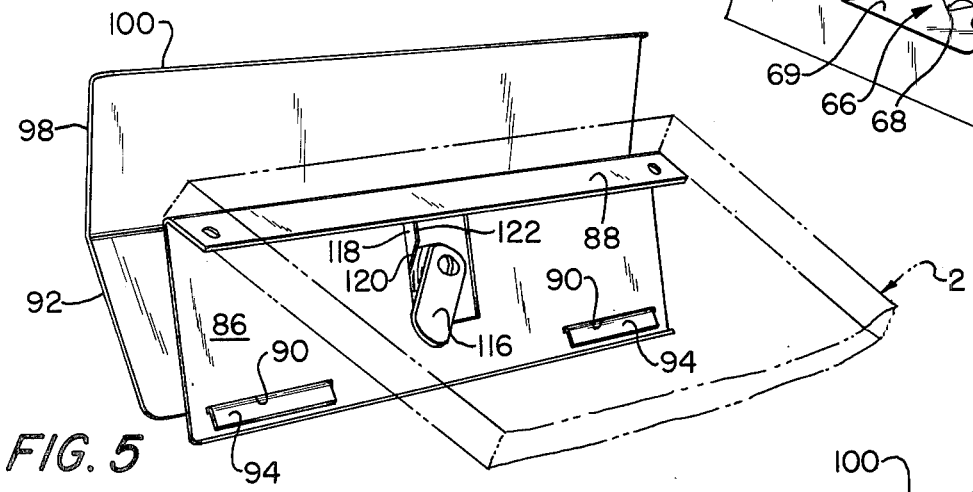
FIG. 5 is a perspective view of the locking plate assembly in unlocked or open position.

Referring now to FIGS. 3, 4 and 7, plate 2 is made large enough to accommodate several bound volumes or books. These volumes consist of loose-leaf cartridge-type binders or holders 42 which are generally the same as the ones disclosed in Modern Office Procedures, Vol. 20, No. 12, Page 42, December 1975, and Information and Records Management, Vol. 9, No. 9, Page 9, September, 1975. The holders 42 are molded of a suitable plastic e.g., polypropylene and may be one-piece units or they may be made of two or more parts secured together. Each of the holders has a pair of oppositely inclined side walls 44 and 46, a pair of integral depending limbs 48 and 50, and one or more transversely extending reinforcing struts 52. The limbs 48 and 50 define a channel 54 for receiving the margins of a plurality of documents or loose-leaves 56. Each holder 42 also includes document binding means in the form of posts 58 which extend across the channel 54 through suitable openings in the leaves 56 and are connected to the limbs 48 and 50. Binding posts 58 are preferably made of plastic and have a head 60 at one end and a flange 62 at the other end to interlock with limbs 48 and 50 respectively. Additionally, each post is split at the end which has the flange 62 so as to form two spring like resilient sections 64 that can be caused to yield towards one another to permit the flange 62 to be released from limb, 50, whereby the post 58 can be retracted in the direction of the arrow shown in FIG. 7 so as to permit leaves to be added to or removed from the holder. The posts are reengaged with the limb 50 by forcing them through the opening in limb 50. The junction of inclined side walls 44 and 46 comprises a V-shaped section 65 which is sized to nest in and interlock with the grooves 20 of ribs 16 and 18. V-shaped section 65 may extend fully along the spine of the holder or it may be formed only adjacent opposite ends of the spine and long enough so as to be able to interlock with the grooves 20 of ribs 16 and 18.

Additionally, each holder is formed with a notch 66 and a hook 68. The notch 66 is sized to accommodate the rib 4 and its flange 6 and the hook 68 is shaped to provide a reentry portion 70 to accommodate part of flange 6 and lip 8. The hook 68 is sized and shaped so that it will pass into the opening 14 formed between lip 8 and the upper surface 26 of the board and make a snap fit with the fin 10, whereby the holder 42 is releasably attached to the book support plate 2. In this connection it is to be noted that the surface 69 of the holder which defines notch 66, hook 68 and reentry space 70 is flat and extends at a right angle to limbs 48 and 50. The holder is restrained against lateral movement by interlocking of its V-shaped section 65 with grooves 20 in ribs 16 and 18 and cannot be lifted away from the plate 2 by virture of the interlocking of hook 68 with lip 8 and fin 10. The flat surface 69 and the adjacent flat surface of flange 6 cooperate to stabilize the holder so that it will not tilt to one side or the other. Removal of a holder can be achieved only by pressing the holder down against plate 2 and simultaneously urging it in the direction of the arrow in FIG. 3, whereby hook 68 will snap free of fin 10. Attachment of a holder is achieved by placing its V-shaped section 65 in aligned grooves 20 in ribs 16 and 18 and sliding the holder downward so that its hook 68 slides under lip 8 and interlocks with fin 10.

As is believed obvious, a number of books comprising binders as previously described can be supported on plate 2 and any one of the books can be opened for reference purposes without having to remove it from the holder. On the other hand, the holder may be removed if it is necessary to do so for the purpose of inserting or removing pages or for using it elsewhere.

The stand also is provided with a pair of "flyleafs" which serve as supports for the pages of the holders when a book is opened. For this purpose, the plate 2 is provided with two rows of holes 74 and 76 which are uniformly and correspondingly spaced. The flyleafs are in the form of U-shaped wire elements similar in shape to the leg unit 28. More particularly each flyleaf is formed of a length of wire which is bent so as to form a connecting section 78, a pair of arms 80, and a pair of angulated end sections 82 formed at the ends of arms 80. Angulated end sections 82 make a snug fit in holes 74 and 76. The flyleafs may be moved closer or further away according to the number of books attached to the stand. Arms 80 are disposed with respect to end sections 82 so that the flyleafs will be able to support the opened portions of a book at an angle suitable for reading. The arms also serve to relieve the stress that might be imposed on the leaves 56 when the latter are bent over the limbs 48 and 50 of the holder. This minimizes the risk of the leaves tearing away in the region of the holes through which the posts 58 extend.

The book stand also may be provided with means for securing the holders in place so as to limit pilfering. The locking assembly is illustrated in FIGS. 2–6. Essentially, the locking assembly comprises a plate 86 which is formed with a flange 88 that is secured by suitable screws (not shown) to the underside of plate 2 adjacent its upper end. Plate 86 is formed with two elongated openings 90 adjacent its lower edge. Also forming part of the locking assembly is a locking plate 92 which is formed with a pair of tongues 94 at its bottom edge. The tongues 94 are offset with respect to the bottom edge of plate 92. The latter also is bent so as to form an angular section 98 and a lip 100. Tongues 94 are disposed in the elongated openings 90 in plate 86 so that plate 92 can swing or pivot relative thereto. The offset of tongues 94 from plate 92 and the width of openings 90 are sized so as to permit the two plates to pivot relative to one another with the tongues serving as hinge elements that pivot relative to plate 86.

Plate 92 may be locked flat against the plate 86 as shown in FIG. 3, or it may be allowed to pivot away as shown in FIG. 2. For this purpose plate 86 is provided with a relatively large vertically elongate hole 104 and plate 92 is provided with a hole in order to accommodate a lock unit 106. The lock unit is provided with a flange 108 which engages the outer side of plate 92 and is threaded to receive a nut 110 which engages the inner side of plate 92, whereby the lock unit is secured to plate 92. The lock is adapted to receive a key 112 which is used to operate the lock. The lock comprises a stem 114 which is rotated when the key is turned and which has affixed to its inner end an arm 116. Plate 86 is formed with a projection 118 on the side facing away from plate 92. The projection 118 is along one side of opening 104 and comprises an inclined surface 120 and a shorter surface 122 which extends parallel to the plane of plate 86. Arm 116 which is operated by the lock is disposed away from plate 92 far enough so that when plate 92 is swung up against plate (FIG. 3), the arm can be forced up behind the surface 122 of projection 118. Arm 116 is made slightly resilient so that when it is rotated to locking position it engages and is cammed by surface 118 away from plate 86 so as to move behind and frictionally engage surface 122. This assures that the plate 92 will be held tight against plate 86 and upper section 98 of plate 92 will not be able to move loosely relative to the adjacent end of the holders 42 which may be attached to the plate 2. The purpose of lip 100 on plate 92 is to interlock with holders 42 so as to inhibit or prevent the upper end of the holders from being lifted away from the board. At the same time the angulated plate portion 98 prevents the holders from being moved parallel to upper surface 26 of plate 2 in the direction shown by the arrow in FIG. 3. In this connection it is to be noted that the holders 42 are of the type which are formed with hooks 126 at their opposite ends whereby the holders when detached from the book stand may be stored in file cabinets or drawers of the type which have a pair of side rails for supporting conventional hanging file folders.

Lip 100 engages or closely overlies the adjacent hooks 126 to lock the holders to the book stand 2.

It is to be understood that as used herein the term "book" is intended to denote a collection of information-bearing documents or pages attached to a holder or binder, and the book may or may not include front and/or back covers. However, the book includes a hook along its back or spine for interconnecting with the rib 4. By way of example but not limitation, any of the following are "books" for the purpose of this invention: catalogs, parts and other reference manuals, computer printouts, reports, and the like.

A person skilled in the art will appreciate that book stands made in accordance with the present invention have utility and advantages even though loose-leaf holder means different than those herein described are used to provide bound volumes which can be mounted and detached as herein contemplated. Thus, the holder or binder which forms part of the book may be made otherwise than as specifically illustrated and described herein. For example, the holders need not be formed with hooks as shown at 126 but instead could be formed with a groove or slot in one end to receive the lip 100, whereby the upper ends of the holders may be locked tight against rib 16 in the manner accomplished by interaction of lip 100 with the adjacent hooks 126. It is further contemplated that a second locking means may be attached to the lower end of the board 2, so as to provide still further insurance against pilfering. In such case, of course, the legs at the upper and lower ends of the board would be made longer in order to accommodate the full length of the locking assembly.

A person skilled in the art will further appreciate that the apparatus herein disclosed and illustrated may be modified in still other ways without departing from the spirit and scope of the invention.

What is claimed is:

1. A book support for supporting a plurality of books in reading position, each of said books having a spine section with a hook, said support comprising a book support plate, means on said plate for interlocking with the hooks of said books, said means comprising a rib extending laterally of and attached to said plate, a flange carried by said rib and spaced from said plate, and a fin on said flange extending toward but spaced from said plate for making a snap fit with said hooks, rib, flange and fin forming an open channel extending for substantially the width of the plate so that books supported thereby may be placed at various positions along the channel, and additional means on said plate for interacting with the spine of said books so as to restrain said books against movement in a lateral direction.

2. A book support as defined by claim 1 wherein said additional means comprise at least one rib with a plurality of grooves therein for interlocking with the spines of said books.

3. A book support according to claim 1 further including means for interlocking with one end of said books so as to prevent said books from becoming detached from said plate.

4. A book support according to claim 3 wherein said means for interlocking with one end of said books comprises a locking plate pivotally attached to said support plate and key-operated lock means for locking said locking plate in position to interlock with said books.

5. A book support according to claim 1 wherein said support plate is molded of a plastic material and said rib flange are formed as integral extensions of said plate.

6. A book support according to claim 5 wherein said means for interacting with the spines of said books comprises a plurality of grooves for receiving said spines.

7. A book support according to claim 6 wherein said support plate includes a raised section extending parallel to said rib and said grooves are formed in said raised section.

8. A book support in accordance with claim 6, wherein said grooves are oriented in a direction transverse to the lateral direction of said rib.

9. A book support according to claim 1 further including means for elevating one end of said support plate so that said books are inclined for easier reading.

10. A book supportt according to claim 1 further including means attached to said support plate for supporting the spread-apart pages of an open book.

11. A book support according to claim 1 further including a plurality of books each having a hook engaged with said interlocking means.

12. A book support in accordance with claim 11, wherein said additional means comprise at least one rib with a plurality of grooves therein for interlocking with the spines of said books.

13. A book support in accordance with claim 1, wherein said plate has upper and lower ends and said flange extends from said rib toward said upper end, and further including means for elevating said upper end of said plate with respect to said lower end.

* * * * *

UNITED STATES PATENT AND TRADEMARK OFFICE

CERTIFICATE OF CORRECTION

PATENT NO. : 4,066,168

DATED : January 3, 1978

INVENTOR(S) : Jerome M. O'Toole et als

It is certified that error appears in the above-identified patent and that said Letters Patent are hereby corrected as shown below:

Column 6, line 1: Insert the word "said" before the word "rib"

Column 6, line 22: Insert the word "and" after the word "rib"

Column 6, line 37: Delete the second "t" in the word "supportt"

Signed and Sealed this

*Twenty-eighth* Day of *March 1978*

[SEAL]

*Attest:*

RUTH C. MASON
*Attesting Officer*

LUTRELLE F. PARKER
*Acting Commissioner of Patents and Trademarks*